United States Patent [19]

Barnhart

[11] Patent Number: 4,876,981

[45] Date of Patent: Oct. 31, 1989

[54] BICYCLE SAFETY FLAG

[76] Inventor: Jill P. Barnhart, 2837 E. Arden Ln., Merced, Calif. 95340

[21] Appl. No.: 106,628

[22] Filed: Oct. 8, 1987

[51] Int. Cl.[4] ..... G09F 17/00

[52] U.S. Cl. ..... 116/173; 116/28 R; 40/214; 280/288.4

[58] Field of Search ..... 116/173, 174, 2, 209, 116/28 R, 210; 244/153 R, 155 R; 280/288.4; 40/214, 215, 590, 591

[56] References Cited

U.S. PATENT DOCUMENTS

| | | | |
|---|---|---|---|
| 1,066,045 | 7/1913 | Pass . | |
| 1,968,838 | 8/1934 | Lanagan . | |
| 2,632,269 | 3/1953 | Sauders | 116/173 |
| 2,764,122 | 9/1956 | Irvin | 116/173 |
| 2,804,276 | 8/1957 | Hutson | 244/153 R |
| 3,219,010 | 11/1965 | Hyatt | 116/173 |
| 3,350,041 | 10/1967 | English | 244/153 R |
| 3,586,348 | 6/1971 | Rich . | |
| 3,614,132 | 10/1971 | Ashworth | 280/289 R |
| 3,812,815 | 5/1974 | Kuenzel | 116/173 |
| 3,878,810 | 4/1975 | Conrad . | |
| 3,946,699 | 3/1976 | Mirshak | 116/174 |
| 3,963,307 | 6/1976 | Kirk | 116/28 R |
| 4,024,833 | 5/1977 | Pook et al. | 116/174 |
| 4,050,404 | 9/1977 | McMackin | 116/209 |
| 4,190,218 | 2/1980 | Cousens, Jr. | 244/153 R |
| 4,558,862 | 12/1985 | Kelly | 116/173 |
| 4,778,132 | 10/1988 | Stoecklin et al. | 244/155 R |

FOREIGN PATENT DOCUMENTS

| | | | |
|---|---|---|---|
| 0144278 | 6/1985 | European Pat. Off. | 244/153 R |
| 1038366 | 9/1953 | France | 40/215 |
| 8695 | of 1905 | United Kingdom | 116/173 |

OTHER PUBLICATIONS

"The Toys" reference, Nov. 1979, pp. 2–8.

*Primary Examiner*—William A. Cuchlinski, Jr.
*Assistant Examiner*—Thomas B. Will
*Attorney, Agent, or Firm*—Christie, Parker & Hale

[57] ABSTRACT

A combination bicycle safety flag and kite is disclosed which offers greater visibility than previous designs. As a bicycle safety flag, it is fastened atop a pole which is bolted to the bicycle. The flag may also be removed for use as a full-fledged small kite.

14 Claims, 2 Drawing Sheets

BICYCLE SAFETY FLAG

FIELD OF THE INVENTION

This invention relates to bicycle safety flags and to kites and, specifically, to a bicycle safety flag which provides greater safety over prior bicycle safety flags and can also be used as a kite.

BACKGROUND OF THE INVENTION

During the 1970's, when gasoline became scarcer and people became more aware of physical fitness, there was a renewed interest in the use of bicycles. The increased use of bicycles has continued to today. This increase in bicycle traffic has created a renewed interest in and greater need for bicycle safety.

The primary hazard to bicyclists has been inattentive motor vehicle drivers. Since bicycles move much more slowly than motor vehicles and are relatively less common, bicycles are often unnoticed. Devices have been sought to make bicycles more conspicuous both at long distances and at close range. The particular problem has been that bicycles are often hidden behind parked cars or other low objects in places where motorists are not accustomed to looking for moving objects.

One device strongly endorsed at one time, but now relatively uncommon, was the bicycle safety flag. A popular type of bicycle safety flag is described in U.S. Pat. No. 3,878,810 to Conrad. This type of bicycle safety flag is illustrated in FIG. 1. It consists of a long spring-mounted pole 10. A spring-mount 12 is bolted to the rear wheel axle 14 where it meets the bicycle frame 16. The pole then rises vertically 4 or 5 feet from the spring-mount. At the top of the pole is a small flag 18. Usually the flag is a triangular pennant, approximately 6 inches tall and 9 inches long, colored bright orange or yellow.

The pennant is supposed to make the bicycle more noticeable. The pennant is mounted above the head of the rider so that the pennant itself is visible at heights above the height of the bicycle and rider. It can be effective in making a low bicycle visible over obstructions, like parked cars, when the bicycle is viewed from the side. While the bicycle is in motion the pennant is blown backwards and aligns itself parallel to the direction of the wind. This makes the pennant visible when approached from the side. However, the thin pennant is largely invisible when approached from the front or rear.

The small pennants have an additional problem. In changing winds, they often become wrapped around the pole on which they are mounted. The bicycle rider must therefore stop periodically to unfurl the flag in order to maintain maximum visibility.

Because the conventional bicycle safety flag does not substantially enhance the visibility of the bicycle seen from the front and rear, front and rear visibility usually has been addressed with reflectors. Reflectors have been mounted both on the front and the back of bicycles in various locations, sizes and styles. However, reflectors mounted on bicycles are not visible at heights above the height of the bicycle and rider and are not effective at night when they reflect the light from oncoming motor vehicles.

FIG. 2 shows a sign seat-brace assembly as disclosed in U.S. Pat. No. 3,586,348 to Rich, Jr. This assembly has a flat circular sign means 20 mounted on a brace 22 extending upward from the bicycle rear wheel axle and supporting the rear of an elongated bicycle seat. Sign means 20 provides a warning signal that is visible to a certain degree. However, it is largely invisible when approached from the sides and its height is limited because it is not flexibly attached to the bicycle to bend under low overhangs.

Accordingly, a need exists for a bicycle safety flag that is highly visible from all directions and that could be highly visible during both day and night hours.

SUMMARY OF THE INVENTION

The present invention, when mounted on a bicycle, is much more conspicuous than previous designs. It can easily be seen from all directions. It is also fit for use as a kite, banner, wind sock or interior decoration.

The present invention has a flag body which can be made of any sheetlike material, for example, fabric, plastic or leather. The sheeting is mounted to a semi-rigid outer frame that maintains the flag's shape. Hanging from the bottom or sides of the flag body are several streamers. The streamers fly in the wind, increasing the flags visibility and providing a speed indicator for motorists. The flag body and streamers are mounted to a vertical pole, the other end of which is fastened to the bicycle. The pole can be either flexible or spring-mounted. It fits into a sleeve that runs along the length of the flag body, holding the flag in place but allowing it to be installed and removed easily.

The flag body can also be outfitted with kite string and used as a kite or it can be outfitted with straps. The straps make the kite easy to carry or hang, for example, on a wall.

DETAILED DESCRIPTION OF THE INVENTION

Figure 1:
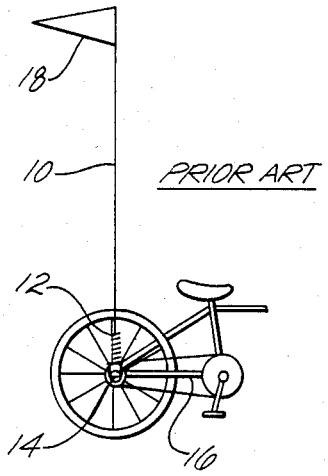
FIG. 1 shows a side view of a bicycle flag in the prior art.
Figure 2:
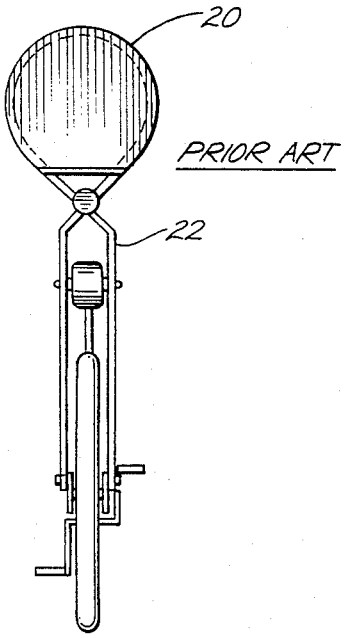
FIG. 2 shows a rear view of a bicycle safety sign in the prior art.
Figure 3:
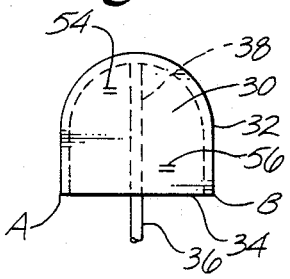
FIG. 3 shows a front view of a preferred embodiment of the present invention without streamers but with the mounting pole.

A presently preferred embodiment of the present invention has three primary components. FIG. 3 shows the flag portion. This portion consists of a Ripstop nylon body 30 stretched over a flexible inverted-U-shaped frame 32. The frame extends over the upper arch perimeter of body 30 between points A and B, but not along the bottom of the perimeter 34. Frame 32 is made from a sturdy plastic member having a U-shaped cross section to enhance its sturdiness. The frame is flexible but the plastic member has a memory that tends to keep it bowed outward so that body 30 is maintained in a stretched out configuration. Body 30 is made from two pieces of nylon fabric overlaying one another. The plastic member is contained within a sleeve formed along the upper arch perimeter of body 30 by sewing together the two pieces of nylon fabric at the edges with monofilament thread and then sewing together the two pieces of fabric along a line spaced from the edges. All the sewing is done so as to prevent fraying and unraveling.

Nylon is used for the body of the flag because it is lightweight and durable, although any other fabrics having these properties could be used as well. The fabric is treated with ultraviolet light inhibiting, water repellant and flame retardant coatings. These coatings further enhance the fabric's durability, prevent fabric colors from fading, allow the fabric to be washed off with water and make the fabric safe for use indoors. The fabric is usually brightly colored and can include some sort of design. The fabric can also be treated or have attachments to make it reflective or glow-in-the-dark so that the flag is highly visible at night as well as during the day.

One example of an alternate fabric is film mylar which is available from Dupont. Film mylar is not as durable as nylon but it is not as expensive either. However, the durability of film mylar can be enhanced by incorporating in the film layers that provide ultraviolet light inhibition, water repellency and flame retardation. Film mylar is also available in a wide variety of colors and finishes. For example, the film mylar can be transparent or can have a metallized finish.

In the presently preferred embodiment, the flag is approximately 14 inches high and 11 inches wide, although other sizes are possible. This size was chosen because it is sufficiently large to be easily seen, but not too bulky. The flag is therefore easily carried in common book bags and backpacks.

Figure 4:
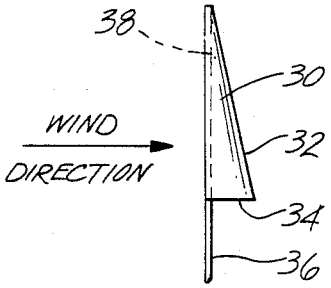
FIG. 4 shows a side view of a preferred embodiment of the present invention while the invention is in motion without streamers but with the mounting pole.

The flexible plastic frame holds the body in shape but yields easily on impact or in the wind. As shown in FIG. 4 when the flag is pushed through the wind, the flexible frame 32 and the flag body 30 are pushed backwards. The pole on which the flag is mounted 36 remains relatively vertical. Because the flag has no frame along its bottom edge 34, it bends easily there. This adds a third dimension to the normally flat flag making it visible from all directions.

The flag is mounted to the mounting pole 36 using a sleeve 38 sewn into the nylon body of the flag. The entire flag can be quickly installed simply by sliding the mounting pole into the sleeve. The flag can just as easily be removed. It is desirable for the flag to be easily installed and removed to prevent theft and to make the flag available for other uses. If difficulty is encountered in keeping the flag on the mounting pole due to high wind speeds, a rubber band can be wrapped around the pole at the base of body 30 and one of the streamers described below pulled through the rubber band. This will releasably maintain the flag on the end of the pole.

The sleeve mounting system also has a safety benefit. If the flag becomes caught on a stationary object, such as a low hanging branch, while the bicycle is in motion, the flexible pole is simply pulled backward on its mounting bracket towards the stationary object. The flag is then pulled off the end of the pole as the bicycle continues forward. This will occur even if a rubber band has been used to help keep the flag on the end of the pole because the rubber band will stretch and release the flag. Thus, the sleeve mount eliminates the potential hazard to the bicycle rider of being knocked down if the flag gets caught in something. The bicycle rider simply returns and retrieves his or her flag when it is pulled off.

Figure 5:
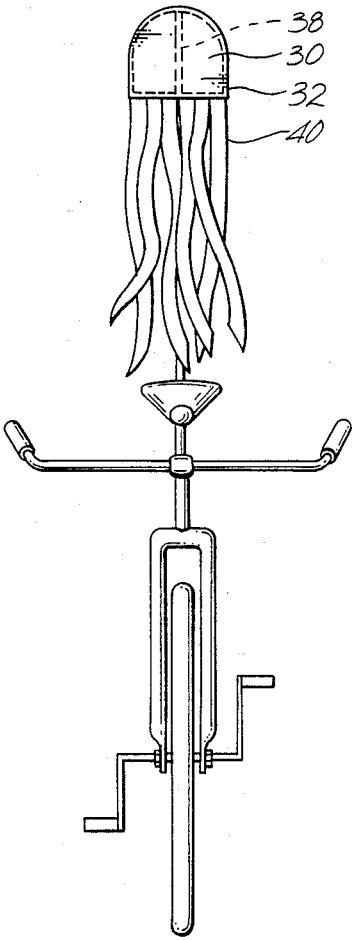
FIG. 5 shows a front view of a preferred embodiment of the present invention with streamers.

The second component is the streamers 40, illustrated in FIG. 5. The preferred embodiment uses 6 streamers approximately 33 inches long and 3 inches wide. These are made of the same fabric as the body and are sewn along the base of the body, as shown in FIG. 5. The number, precise dimensions and fabric can be varied, of course. The invention can also be made without streamers or with substantially no body and streamers only. However, it is thought that the use of medium long streamers and a body makes a better flag and allows the flag to be put to other uses.

In addition to their festive appearance, the streamers greatly enhance the visibility of the flag. The streamers flutter in the wind, more than doubling the apparent size of the flag and improving its visibility in all directions. In addition, they give a rough indication of the bicycle's speed. The streamers will lie near vertical when the bicycle is stationary and will be more horizontal when the bicycle is moving quickly.

Figure 6:
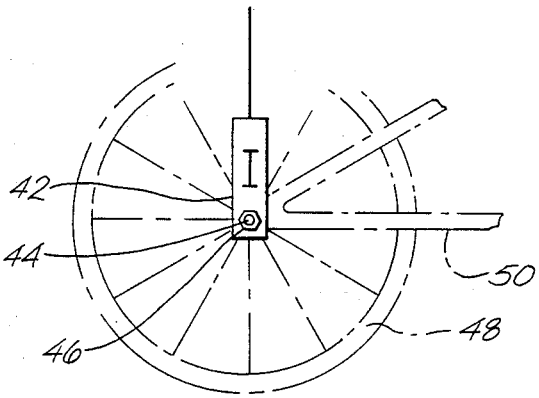
FIG. 6 shows a side view of a mounting bracket for the mounting pole.

The third component is the flexible pole 36. The pole is fastened to the bicycle on one end and supports the flag on the other. It is not important to the invention how the pole is mounted to the bicycle, but typically the pole ends in a bracket 42 with a hole in it (FIG. 6). The bracket is bolted on to the rear wheel axle 44 using the same nut 46 that holds the rear wheel 48 to the bicycle frame 50. The bracket is formed to fit over the frame. This prevents rotation of the pole around the axle. The bracket also has outwardly extending flanges along each side to strengthen the bracket.

While the type of mounting bracket is not important, it is important that the mounting pole be made of a flexible material or be spring mounted on the bicycle. The pole must be able to bend out of the way when it hits stationary objects, for example, low tree branches or garage doors. It is also easier to install and remove the flag if the top of the mounting pole can be bent down to a more convenient height. Having the pole made of a flexible material is presently preferred over spring mounting because young children can get their fingers struck in a spring mounting.

The present invention is more than simply a bicycle safety flag. First, the present invention is a fully functioning kite. In the presently preferred embodiment, it comes equipped with upper 54 and lower 56 eyelets, depicted in FIG. 3. The safety flag can easily be removed from the bicycle mounting pole, then, by fastening a string between the 2 sets of eyelets, a kite bridle is formed. Kite string can then be fastened to the bridle and the bicycle safety flag becomes a small kite.

Figure 7:
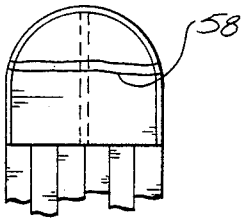
FIG. 7 shows a rear view of a preferred embodiment of the flag of the present invention with the streamers broken to illustrate the location of the straps.

The present invention is also fitted with a nylon strap 58 as shown in FIG. 7. This strap makes the invention easy to carry or hang on the wall as a decorative item. The invention can also be used on poles placed in the ground as a decorative banner or a movable wind sock. The festive appearance of the invention and its flowing streamers make it perfect for use in gymnastics or dance routines. The invention can also function as a combined pom pom and pennant for use by cheerleaders or sports fans. For this use, the safety flag would be in the particular sports team's colors and could be decorated with a picture of the team mascot. Clearly, many other uses may develop.

The above description of a preferred embodiment presents several specifics of design, including choice of fabric and dimensions. It will be obvious to one skilled in the art that the present invention can be made in a variety of shapes, sizes, formats, and fabrics without departing from the spirit or scope of the invention as a whole. By describing this preferred embodiment, the inventor does not intend, in any way, to abandon or give up rights in other embodiments which are within the spirit and scope of the invention as a whole.

What is claimed is:

1. A bicycle safety flag comprising:

a mounting pole adapted for fastening to a bicycle frame at one end, rising substantially vertically from that end; and a body mounted at the opposite end of the mounting pole having a flexible plastic upper perimeter frame, a fabric sheet stretched over the frame, the fabric sheet having an upper perimeter supported by the frame and a bottom edge not supported by the frame, and a vertical sleeve along the fabric sheet spaced apart from the ends of the frame into which the mounting pole can be inserted for mounting the body to the mounting pole.

2. The bicycle safety flag described in claim 1 also comprising streamers connected to the fabric sheet.

3. The flag of claim 2 wherein the streamers are at least twice as long as the longest dimension of the fabric sheet.

4. The bicycle safety flag described in claim 1 also comprising straps forming handles with which the bicycle safety flag may be carried, mounted and hung.

5. The bicycle safety flag described in claim 1 also comprising means for mounting a kite string to the fabric sheet, the means enabling the bicycle safety flag to be flown like a kite.

6. A bicycle safety flag comprising:

mounting means adapted for fastening to a bicycle;

flag means adapted for mounting to the mounting means, the flag means extending in a plane substantially perpendicular to the normal direction of bicycle travel;

frame means for maintaining the flag means in a substantially planar configuration but adapted to allow at least a portion of the flag means to move backward relative to the bicycle when acted upon by the apparent wind caused by bicycle travel so that the flag means assumes a three-dimensional configuration.

7. The bicycle safety flag of claim 6 also comprising streamers fastened to the flag means.

8. The flag of claim 7 wherein the streamers are at least twice as long as the longest dimension of the flag means.

9. The bicycle safety flag of claim 6 also comprising straps fastened to the flag means for allowing the flag means to be carried, mounted and hung independently of the mounting means.

10. A bicycle safety flag comprising:

a fabric sheet, the perimeter of the sheet having a substantially straight portion and a curved portion, the ends of the curved portion intersecting the ends of the straight portion;

a flexible frame connected to the curved portion for biasing the sheet towards a flattened position;

a mounting pole having a first end adapted to removably engage the sheet and a second end adapted to be mounted to a bicycle; and at least one fastener connected to the sheet for receiving the pole so that the pole extends from a location proximate the midpoint of the straight portion towards the curved portion in a direction substantially perpendicular to the straight portion.

11. The flag of claim 10 further comprising a plurality of streamers fastened to the straight portion.

12. The flag of claim 11 wherein the streamers are at least twice as long as the longest dimension of the sheet.

13. The flag of claim 10 further comprising at least one eyelet within the sheet for fastening a kite string.

14. The flag of claim 10 further comprising at least one strap fastened to the sheet.

* * * * *